US005300209A

United States Patent [19]

Mori

[11] Patent Number: 5,300,209

[45] Date of Patent: Apr. 5, 1994

[54] ANODIZING METHOD AND APPARATUS

[75] Inventor: Hisatoshi Mori, Hachioji, Japan

[73] Assignee: Casio Computer Co., Ltd., Tokyo, Japan

[21] Appl. No.: 992,605

[22] Filed: Dec. 18, 1992

[30] Foreign Application Priority Data

Dec. 24, 1991 [JP] Japan ..... 3-355632

[51] Int. Cl.[5] ..... C25D 11/04

[52] U.S. Cl. ..... 205/325; 205/324; 204/242; 204/400; 204/412; 204/435

[58] Field of Search ..... 205/80, 324, 325; 204/400, 412, 435, 242

[56] References Cited

U.S. PATENT DOCUMENTS 4,108,736 8/1978 Rigo et al. ..... 205/188

4,131,520 12/1978 Bernard et al. ..... 205/171

*Primary Examiner*—Kathryn Gorgos

*Attorney, Agent, or Firm*—Frishauf, Holtz, Goodman & Woodward

[57] ABSTRACT

An anodizing method, wherein an aluminum based-system alloy film formed on an insulation substrate is soaked in an electrolytic solution of an ammonium borate water solution, and a voltage is applied between a to-be-anodized film of the aluminum system alloy film functioning as an anode and a cathode soaked in the same electrolytic solution, thereby forming a metal oxide film from the surface of the to-be-anodized film. A resistivity of the electrolytic solution is measured, and ammonia water is added to the electrolytic solution so that the measured resistivity does not exceed 120 Ωcm.

24 Claims, 6 Drawing Sheets

ANODIZING METHOD AND APPARATUS

BACKGROUND OF THE INVENTION

1. Field of the Invention

The present invention relates to a method for anodizing a conductive film such as a metal film formed on a substrate and an apparatus for anodizing the same using this method.

2. Description of the Related Art

In a thin-film element such as a thin-film transistor, a multilayer wiring board, or the like, the withstand voltage between a lower metal film (a lower electrode and a lower wiring layer) and an upper metal film (an upper electrode and an upper wiring layer) interposing an insulation film is considerably increased to prevent a short circuit between the lower and upper films. The lower metal film is thus anodized to form an oxide film on the surface thereof.

The anodic treatment of a lower metal film (a lower electrode and a lower wiring layer) is generally carried out by soaking a substrate (e.g., a glass substrate) on which the lower metal film is formed, in an electrolytic solution so as to oppose the lower metal film to a cathode, and then applying a voltage between them.

When the voltage is applied between the metal film and its opposing negative electrode (cathode) in the electrolytic solution, the metal film serving as a positive electrode (anode), is reacted therein and starts to be anodized from its surface, thereby forming an oxide film thereon. The thickness of the oxide film can arbitrarily be determined by controlling the voltage applied between both the negative and positive electrodes.

In the above-described anodic treatment, the composition of the electrolytic solution slightly varies as time passes, and the quality of the oxide film varies accordingly.

Conventionally, though the anodic treatment is performed while maintaining the fixed concentration of the electrolytic solution, the quality of the oxide film is degraded as time passes.

If a lower metal film of a thin-film element, a multilayer wiring board or the like is anodized by the conventional anodizing method, an oxide film portion formed on the surface of the metal film anodized early has a considerably high acid-resistance, but an oxide film portion formed on that of the metal film anodized late has a low resistance to strong acid such as BHF (buffered hydrofluoric acid).

Since the oxide film has a low resistance to the BHF, it is damaged by etching using the BHF in the subsequent manufacturing step, and a short circuit may be caused between the lower and upper metal films.

As is well-known, in a reverse-stagger thin-film transistor, a blocking insulation film is formed on a channel region of an I-type semiconductor layer. This blocking insulation film is formed to prevent the channel region of the I-type semiconductor layer from being damaged by etching of the surface of the I-type semiconductor layer when a portion of an N-type semiconductor layer formed on the I-type semiconductor layer located between the source and drain electrodes is removed by etching. In general, the blocking insulation film is formed of SiN (silicon nitride) which is the same material as that of a gate insulation film.

The blocking insulation film is formed by forming an SiN film and then patterning it using BHF as an etchant by photolithography. Since the I-type semiconductor layer of a-Si (amorphous silicon) formed under the blocking insulation film is usually generated with pinholes, the etchant passes through the pinholes to etch the gate insulation film (SiN film) formed under the I-type semiconductor layer, with the result that pinholes are formed in the gate insulation film, too. Therefore, the surfaces of a gate electrode and a gate wiring layer, which are formed under the gate insulation film, are exposed to the etchant (BHF) passing through the pinholes of the gate insulation film.

If an oxide film formed on the surfaces of the gate electrode and gate wiring layers is very resistant to strong acid such as BHF, the oxide film is not damaged.

Since, however, the oxide film portion formed on the surface of the gate electrode and the gate wiring layer have a low resistance to the strong acid such as BHF, if such an oxide film is exposed to the etchant such as BHF, it is damaged to cause defects such as pinholes.

If the defects such as pinholes are present on the oxide film formed on the surfaces of the gate electrode and gate wiring layer of the thin-film transistor, the withstand voltage characteristics of the oxide film are deteriorated, with the result that a short circuit occurs between the gate electrode (gate wiring layer) and the source and drain electrodes (data wiring layer).

The generation of the short circuit is not only limited to the thin film transistor, but is true of other thin-film element such as a thin-film diode, a multilayer wiring board, and the like, in which an oxide film on the surface of a lower metal film, which is anodized late, is damaged by etching an insulation film (SiN film) using strong acid such as BHF to cause a short circuit between the lower and upper metal films.

The thin-film element, the multilayer wiring board, and the like having an oxide film formed on the lower metal film using the conventional anodizing method, have a drawback in which the rate of occurrence of short circuits differs from time to time when the lower metal film is anodized, and the manufacturing yield is decreased accordingly.

SUMMARY OF THE INVENTION

It is an object of the present invention to provide an anodizing method and an anodizing apparatus capable of stably forming a good-quality oxide film having a high acid-resistance on a metal film, etc.

To attain the above object, there is provided an anodizing method comprising the steps of soaking a substrate on which a to-be-anodized film for forming an oxide film is formed, into an electrolytic solution in which a cathode is soaked in advance; applying a predetermined voltage between the cathode and the to-be-anodized film serving as an anode; and controlling the electrolytic solution to have a resistivity falling within a predetermined range.

According to the anodizing method, since a variation in the property and composition of the electrolytic solution can be regarded as a variation in the resistivity thereof which can be electrically measured, a slight change in the electrolytic solution can be detected. Since the electrolytic solution is so controlled that its resistivity falls within a predetermined range, the fixed property and composition of the electrolytic solution can always be maintained, and a stable, good-quality oxide film can be formed.

In the anodizing method of the present invention, the good-quality oxide film can be preferably formed if the electrolytic solution is so controlled as to have a resistivity of 120 Ωcm or less, preferably between 100 Ωcm and 120 Ωcm. In the case of a resistivity of less than 100 Ω, a continuous breakdown may occur in the oxide film, resulting in a poor quality oxide film. The resistivity is controlled by adding a control solution of hydrogen ions to the electrolytic solution. When the to-be-anodized film is an aluminum system alloy film, an ammonium borate water solution is used for the electrolytic solution. This ammonium borate water solution is obtained by dissolving ammonium tetraborate tetrahydrate into water and its resistivity is controlled by adding ammonia water thereto.

There are two methods for measuring the resistivity of the electrolytic solution. According to one of the methods, a current is caused to flow between a pair of electrodes soaked into the electrolytic solution to measure a resistance of the electrolytic solution. The resistivity is thus measured from the resistance. According to the other method, a current is supplied to one of paired coils soaked into the electrolytic solution, and an induced current is caused to flow into the electrolytic solution to induce a voltage in the other coil. The resistivity is thus measured based on the voltage Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be described, with reference to the accompanying drawings.

Figure 1:
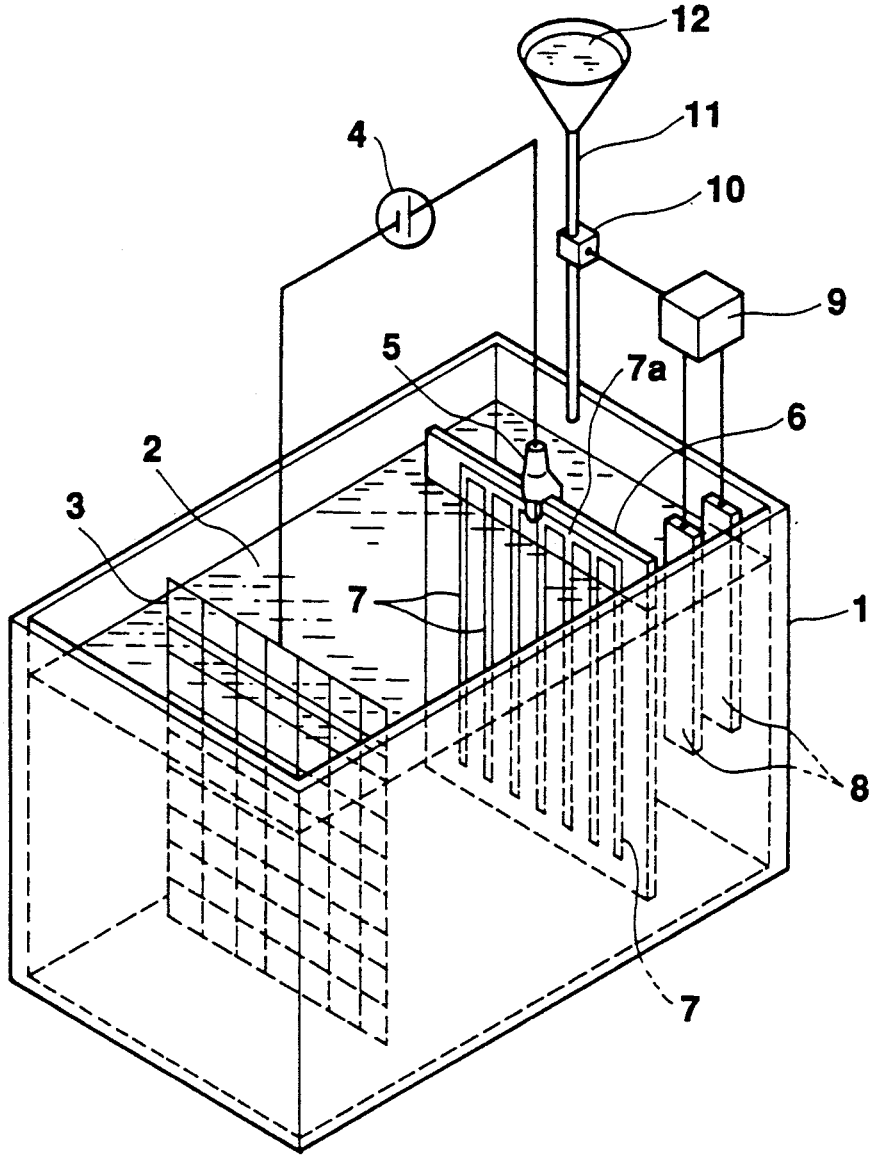
FIG. 1 is a schematic perspective view of an anodizing apparatus according to an embodiment of the present invention.

FIG. 1 shows an anodizing apparatus. This apparatus comprises an electrolytic tank 1 filled with an electrolytic solution 2, a reticulate cathode 3 made of platinum or the like soaked in the electrolytic solution, a to be-anodized metal film 7 opposed to the cathode 3, and a power supply 4 for applying a direct voltage between the cathode 3 and the to-be-oxidized metal film 7. The anodizing apparatus further comprises a pair of measuring electrodes 8 soaked in the electrolytic solution 2 for measuring the resistivity of the electrolytic solution 2, a resistivity calculating device 9 electrically connected to the measuring electrodes 8 for calculating the resistivity of the electrolytic solution 2, a valve 10 opened or closed in response to an output signal of the resistivity calculating device 9, a funnel 11 connected to the valve 10, and a control solution 12 of the resistivity of the electrolytic solution stored in the funnel 11.

The to-be-oxidized metal film 7 is formed on a substrate 6. This substrate 6 is a substrate for a TFT (thin-film transistor) panel used in a TFT active matrix type liquid crystal display element as shown in FIGS. 2 to 4.

Figure 2:
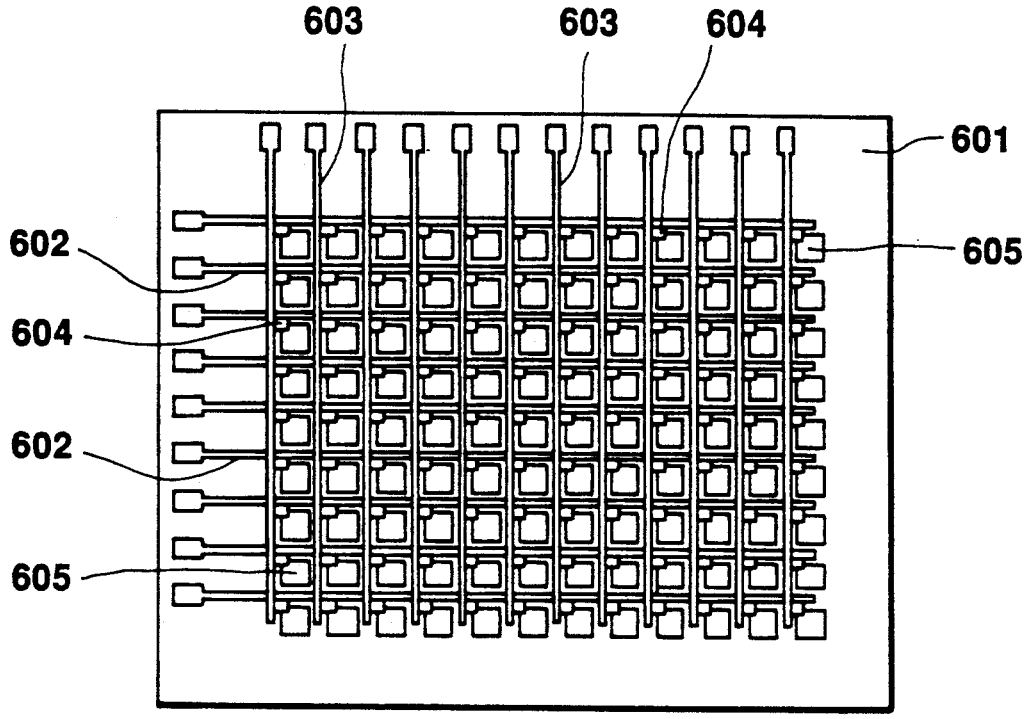
FIG. 2 is a plan view schematically showing a structure of a TFT (thin-film transistor) panel to which an anodizing method of the present invention is applied.

In the TFT panel, as shown in FIG. 2, a plurality of address wiring layers 602 are formed on an insulating transparent substrate 601 constituted by glass or the like, and a plurality of data wiring layers 603 are formed thereon so as to be electrically insulated from the address wiring layers 602 and to cross them almost perpendicularly. A TFT 604 and a pixel electrode 605 connected thereto are formed at each of crossings of the address wiring layers 602 and data wiring layers 603.

Figure 3:
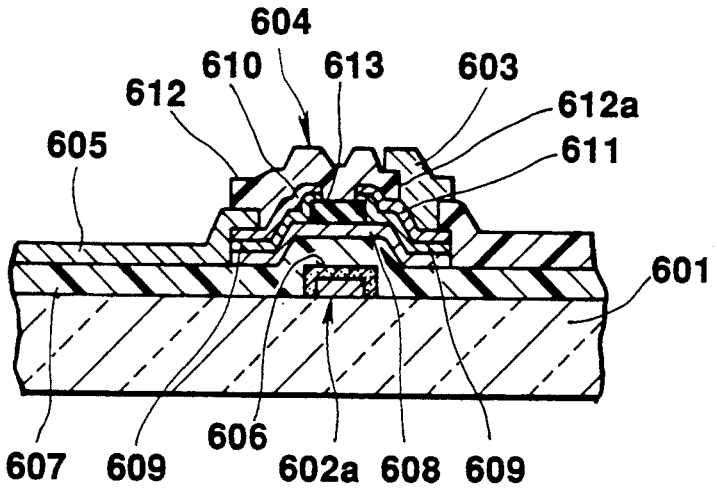
FIG. 3 is a cross-sectional view showing a structure of a TFT formed on the TFT panel shown in FIG. 2.
Figure 4:
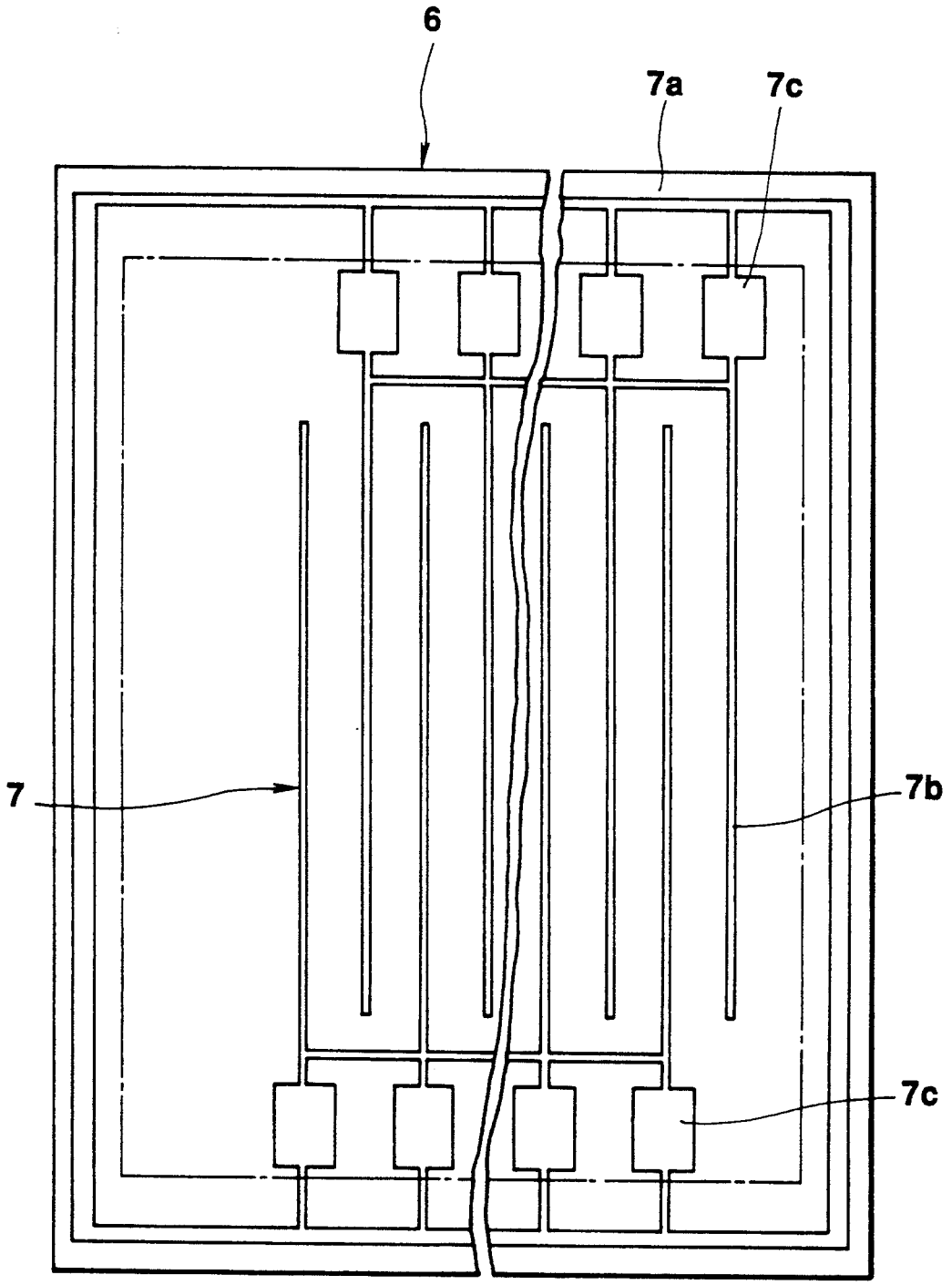
FIG. 4 is a plan view of a to-be-anodized metal film on a substrate, on which an oxide film is to be formed by the anodizing method of the present invention

As shown in FIG. 3, the TFT 604 is so constructed that a gate electrode **602*a* connected to the address wiring layer 602 is formed on the transparent substrate 601, insulation films 606 of an anodized metal film are formed on the surfaces of the address wiring layer and the gate electrode 602*a*, and a gate insulation film 607 covers the insulation films 606. An I-type semiconductor film 608 is formed on the portion of the gate insulation film 607 above the gate electrode 602*a*, and a blocking film 613 is formed on a channel region of the I-type semiconductor film 608. Furthermore, n-type semiconductor films 609 are formed on the I-type semiconductor film 608, and source and drain electrodes 610 and 611 are formed on the N-type semiconductor films 609, respectively. The transparent pixel electrode 605 is connected to the source electrode 610, and the data wiring layer 603 is connected to the drain electrode 611 via an opening 612*a* formed in a protective film 612**.

In the process of manufacturing the TFT panel on which the TFTs are arrayed, the anodizing method of the present invention is applied to a step of forming the insulation film on the surfaces of the address wiring layer and gate electrode **602*a* formed on the insulating substrate. As shown in FIG. 4, the to-be-oxidized metal film 7 is patterned to form the address wiring layers and gate electrodes on the substrate 6. The to-be-oxidized metal film 7, which is constituted by aluminum, aluminum based-alloy containing aluminum and high-melting point metal such as titanium (Ti) and tantalum (Ta) or Ta, includes wiring sections 7*b* serving as the address wiring layers 602 and gate electrodes 602*a*, terminal sections 7*c*** connected to their respective wiring sections 7b, and a voltage supply line 7a connected to the terminal sections 7c and formed on the periphery of the substrate 6.

The metal film 7 of aluminum or aluminum based-alloy is anodized using an ammonium borate water solution as the electrolytic solution 2. This boric ammonia acid water solution is obtained by dissolving ammonium tetraborate tetrahydrate [$(NH_4)_2B_4O_7 \cdot 4H_2O$] (solid) into water by 2.5 wt %, and its resistivity is about 100 Ωcm directly after the dissolution.

Furthermore, the anodizing of the meta film 7 is performed as follows: The substrate 6 on which the metal film 7 is formed, is soaked into the electrolytic solution 2 with the terminal sections 7c covered with resist, the metal film 7 is opposed to the cathode 3 therein, and a direct-current voltage from the power supply 4 is applied between the cathode 3 and the metal film 7. The voltage is applied to the metal film 7 by connecting a clip-shaped connecting member 5 to the voltage supply line 7a which is formed on the periphery of the substrate 6 and separated therefrom in the subsequent step. The voltage may be controlled according to the thickness and material of the oxide film. For example, in the case of an Al oxide film of 2600 Å-thickness, the voltage is 200 V and in the case of a Ta oxide film of 600 Å-thickness, it is 110 V.

When the voltage is applied between the cathode 3 and the metal film 7 in the electrolytic solution, the metal film 7, which is an anode, is reacted therein and starts to be anodized from its surface, thereby forming an oxide film on the surface of the metal film 7. FIG. 4 shows only the gate wiring layer as the metal film 7. The gate electrodes of the TFT are integrally formed on a plurality points of the gate wiring layers. Therefore, the gate electrodes are anodized at the same time when the gate wiring layers are anodized.

The oxide film formed on the surface of the metal film 7 by the anodizing is dense and acid-resistant to strong acid such as BHF when the resistivity of the ammonium borate water solution is about 100 Ωcm directly after the dissolution.

As time passes, the composition of the ammonium borate water solution is changed by evaporation of ammonia, and the resistivity thereof is increased accordingly. If the resistivity is not more than 120 Ωcm, a good-quality and high acid-resistant oxide film is formed on the surface of the metal film 7. If, however, the resistivity exceeds 120 Ωcm, the oxide film formed thereon is degraded.

In the anodizing method described above, the resistivity of the ammonium borate water solution is controlled so as not to exceed 120 Ωcm. The control of this resistivity is executed as follows: The resistance of the electrolytic solution is measured by allowing a current to flow between the measuring electrodes 8, the resistive of the electrolytic solution is obtained by the resistivity measuring device 9 on the basis of the resistance, the valve 10 is operated in response to an output signal of the resistivity measuring device 9, ammonia water stored in the funnel 11 is dropped into the ammonium borate water solution so that the resistivity of the electrolytic solution can be fixed, and the funnel is replenished with ammonia water.

Since the resistivity of the electrolytic solution 2 can be electrically measured, the resistivity of the ammonium borate water solution of the electrolytic solution 2 can always be controlled so as not to exceed 120 Ωcm by adding ammonia water thereto in accordance with the measured resistivity of the electrolytic solution 2.

Figure 5:
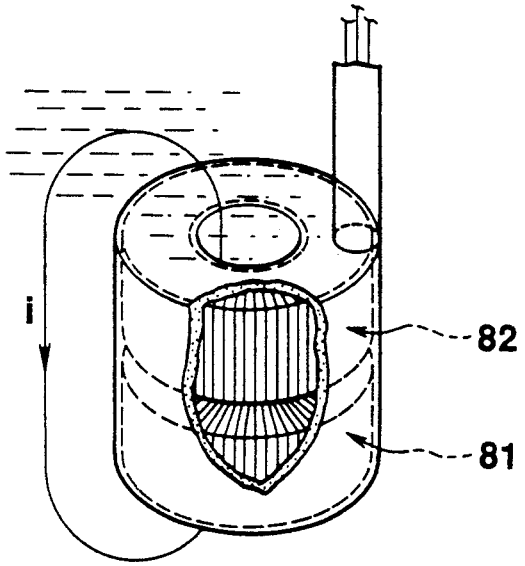
FIG. 5 is a perspective view showing a detection means used in an anodizing apparatus according to another embodiment of the present invention.

One method for measuring the resistivity of the electrolytic solution is that paired electrodes are soaked into the electrolytic solution at a predetermined interval, as shown in FIG. 1, and a resistance between both the electrodes is measured. Another method is that paired coils 81 and 82 are soaked into the electrolytic solution at a predetermined interval, as shown in FIG. 5, an induced current is caused to flow into one 81 of the coils, and a voltage or a current induced in the other coil 82 are measured. In both the methods, the resistivity of the electrolytic solution can be precisely and easily measured.

If the resistivity of the ammonium borate water solution is always controlled so as not to exceed 120 Ωcm, the above-described satisfactory and always stable oxide film can be formed.

Consequently, in the anodizing of the lower metal film (lower electrode and lower wiring layer) of a thin-film element, a multilayer wiring board, or the like described above, a good-quality oxide film, which is dense and acid-resistant to strong acid such as BHF, can be formed not only on the surface of a metal film anodized early, but also on that of a metal film anodized after a number of metal films are anodized.

Figure 6:
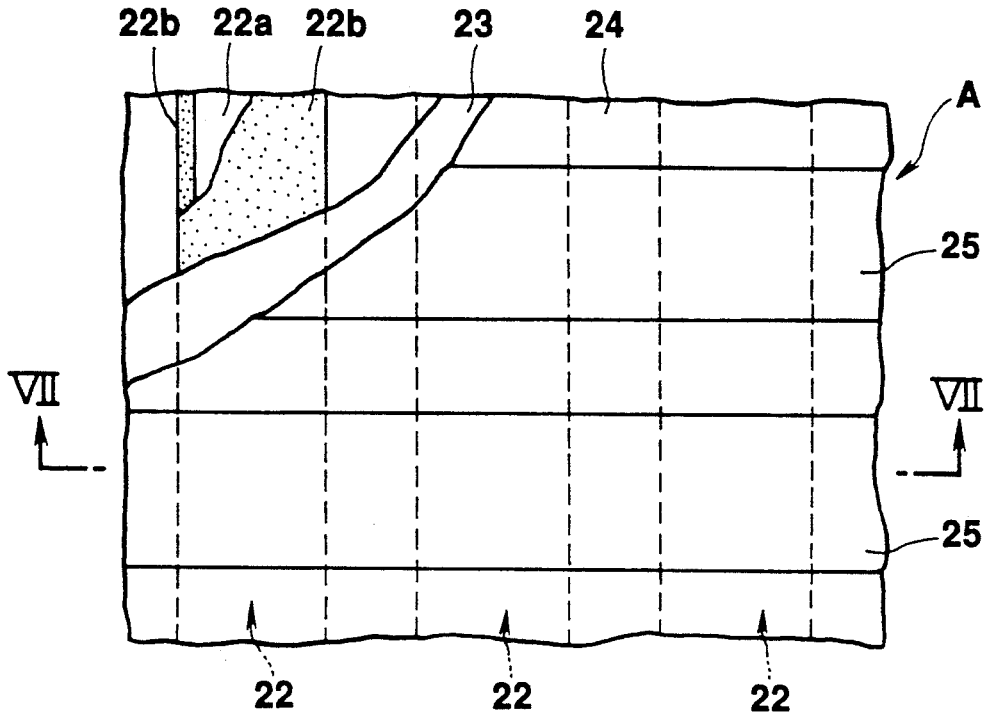
FIG. 6 is a plan view of a defect density measuring sample.
Figure 7:
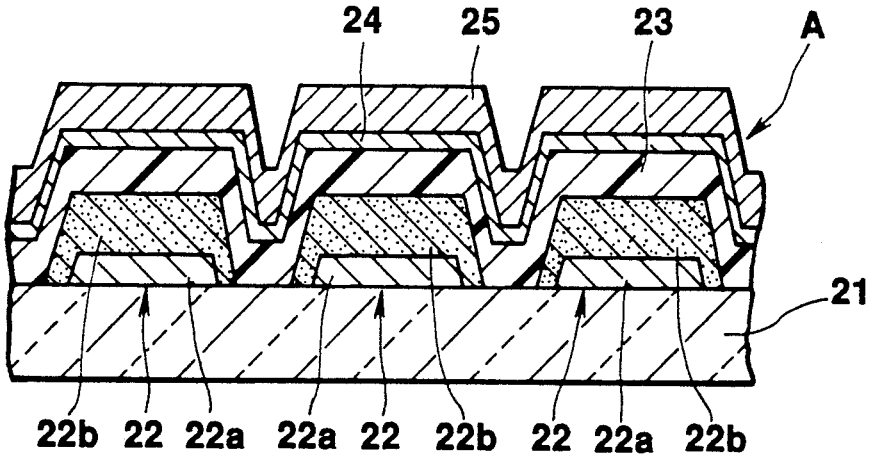
FIG. 7 is a cross-sectional view of the defect density measuring sample taken along the line VII—VII of FIG. 6.

Since, therefore, the oxide film formed on the surface of the lower metal film is not damaged by etching using BHF or the like in the manufacturing process of the thin-film element or multilayer wiring board, the rate of occurrence of short circuits can be reduced, and the yield of the thin-film element or the multilayer wiring board can be improved. These advantages could be confirmed by detecting the density of defects (the number of defects per unit of area) caused between the upper and lower electrodes from a defect density measuring sample A as shown in FIGS. 6 and 7.

The sample A included a number of linear lower electrodes 22 of an aluminum based-alloy containing a very small amount of titanium, which are formed in parallel to one another on a glass substrate 21. The surfaces of the lower electrodes 22 were anodized, and an SiN film 23 and an I-type a-Si layer (I-type semiconductor layer) 24 were formed on the lower electrodes 22. Further, a number of linear upper electrodes 25, which crossed the lower electrodes 22 at right angles, were formed in parallel to one another on the I-type a-Si layer 24.

The sample A was manufactured as follows.

First, the lower electrodes 22 made of Al based alloy were formed o the glass substrate 21 and then anodized using an ammonium borate water solution as an electrolytic solution. In FIGS. 6 and 7, reference numeral 22a indicates inoxidized metal layers of the lower electrodes 22, and numeral 22b denotes oxide films formed by the anodization. The thickness of each of the oxide films 22b was 300 nm.

Next, the SiN film 23 and a-Si layer 24 were formed in sequence to have thicknesses of 200 nm and 50 nm, respectively. The substrate 21 was then soaked into BHF for two minutes in order to reproduce the method for manufacturing, for example, a reverse-stagger thin-film transistor in which a gate insulation film (SiN film) is etched in a pinhole portion of the I-type semiconductor layer and an oxide film on the gate electrode and gate wiring layer is exposed to BHF when a blocking insulation film (SiN film) is patterned.

The upper electrodes 25 were formed on the 1-type semiconductor layer 24 to cross the lower electrodes 22 as described above, resulting in completion of the sample A. In this sample A, the width of each of the lower and upper electrodes 22 and 25 was 150 μm, and an interval between adjacent two electrodes was 50 μm.

The density of defects, that is, a short-circuit caused in the sample A was detected as follows. Whenever a voltage was applied to the lower electrodes 22, it was checked whether the upper electrodes 25 output a current flowing from the lower electrodes 22 to the upper electrodes 25 when a short circuit was caused at the crossings of the lower and upper electrodes. The number of occurrences of the output current was counted as the number of defects (the total number of crossings at which short circuits were caused), and the number of defects was divided by the whole area of the crossings of the lower and upper electrodes 22 and 25, thereby obtaining the density of the short-circuit defects of the sample A.

Figure 8:
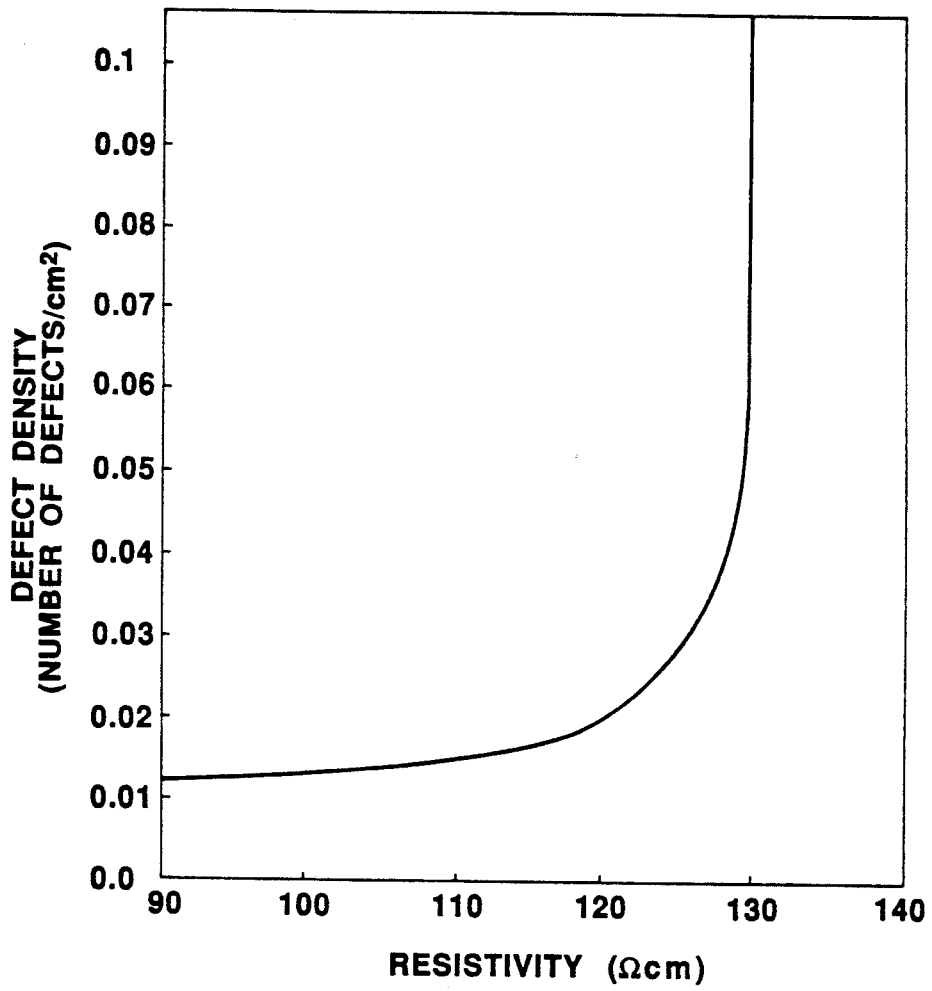
FIG. 8 is a graph showing a relationship between the resistivity of an electrolytic solution when the defect density measuring sample is manufactured based on the present invention and the density of defects caused in the sample.

FIG. 8 shows a relationship between the resistivity of the ammonium borate water solution used for the anodizing of the lower electrodes 22 and the density of defects (the number of defects/$cm^2$) of the sample A.

As is apparent from FIG. 8, if the resistivity of the ammonium borate water solution is not more than 120 Ω, the defect density of the sample A is very low and does not exceed 0.02 (the number of defects/$cm^2$). If the resistivity exceeds 120 Ω, the defect density of the sample A is suddenly increased.

If, therefore, the lower metal film (lower electrode and lower wiring layer) of a thin-film element, a multilayer wiring board or the like is anodized by controlling the ammonium borate water solution of the electrolytic solution 2 so as to have a resistivity of 120 Ω or less, the rate of occurrence of short circuits can be reduced, and the yield of the thin-film element or the multilayer wiring board can be improved.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An anodizing method comprising the steps of:

forming a to-be-anodized film on a substrate;

soaking the substrate on which the to-be-anodized film is formed, in an electrolytic solution in which a cathode is soaked;

applying a voltage between the cathode and the to-be-anodized film, said to-be-anodized film functioning as an anode;

detecting a resistivity of the electrolytic solution; and controlling the resistivity of the electrolytic solution during said applying so that the resistivity of the electrolytic solution falls within a range, by adding a solution including an additive consisting of ammonia water and hydrogen ions to the electrolytic solution, in response to the detected resistivity of the electrolytic solution as detected in the detecting step, whereby a density of defects in the to-be-anodized film, as the to-be-anodized film is anodized, is substantially stabilized.

2. The anodizing method according to claim 1, wherein said controlling step includes a step of controlling the resistivity of the electrolytic solution so that the resistivity thereof is no greater than 120 Ωcm.

3. The anodizing method according to claim 1, wherein said controlling step includes a step of controlling the resistivity of the electrolytic solution so that the resistivity thereof is in the range from 100 Ωcm to 120 Ωcm.

4. The anodizing method according to claim 1, wherein said ions in said solution include hydrogen ions.

5. The anodizing method according to claim 1, wherein the to-be-anodized film is formed of aluminum containing a high melting point metal.

6. The anodizing method according to claim 1, wherein said electrolytic solution is an ammonium borate water solution, and said controlling step includes a step of adding ammonia water to the electrolytic solution.

7. The anodizing method according to claim 6, wherein said ammonium borate water solution is a water solution obtained by dissolving ammonium tetraborate tetrahydrate into water.

8. The anodizing method according to claim 1, wherein:

said detecting step includes a step of measuring the resistivity of the electrolytic solution based on a resistance of the electrolytic solution in which a current flows; and the controlling step includes a step of controlling the resistivity of the electrolytic solution to be no greater than 120 Ωcm.

9. The anodizing method according to claim 1, wherein:

said detecting step includes a step of measuring the resistivity of the electrolytic solution based on a value of an induced current flowing in the electrolytic solution; and the controlling step includes a step of controlling the resistivity of the electrolytic solution to be no greater than 120 Ωcm.

10. An anodizing apparatus comprising:

a tank containing an electrolytic solution;

a cathode soaked in the electrolytic solution in said tank;

a to-be-anodized conductive film formed on a substrate and soaked in the electrolytic solution in said tank;

applying means for applying a voltage between said cathode and said to-be-anodized film;

measuring means for measuring a resistivity of the electrolytic solution; and controlling means for controlling the resistivity of the electrolytic solution measured by said measuring means as said applying means applies said voltage so that the resistivity falls within a range in which a density of defects in the to-be-anodized film, as the to-be-anodized film is anodized, is substantially stable.

11. The anodizing apparatus according to claim 10, wherein:

said measuring means includes a pair of electrodes soaked in the electrolytic solution, said anodizing apparatus further comprising:

means for causing a current to flow between the pair of electrodes; and wherein the measuring means measures a resistance of the electrolytic solution between the pair of electrodes, when the current flows, thereby obtaining the resistivity of the electrolytic solution.

12. The anodizing apparatus according to claim 10, wherein said measuring means includes coil means, having a pair of coils soaked in the electrolytic solution, for supplying a current to flow in the electrolytic solution, said measuring means measuring the resistivity of the electrolytic solution based on a voltage induced in the other one of said pair of coils by the induced current.

13. The anodizing apparatus according to claim 11, wherein said controlling means includes means for controlling the electrolytic solution to have a resistivity of 100 Ωcm to 120 Ωcm.

14. The anodizing apparatus according to claim 10 wherein said controlling means includes means for adding a control solution to the electrolytic solution for controlling a density of hydrogen ions in the electrolytic solution based on the resistivity of the electrolytic solution measured by said measuring means.

15. The anodizing apparatus according to claim 14 wherein:

said to-be-anodized conductive film is a metal film formed on the substrate, said to-be-anodized conductive film is formed of aluminum containing a high melting point metal;

said electrolytic solution is an ammonium borate water solution; and said control solution is ammonia water.

16. An anodizing method, comprising the steps of:

soaking a substrate on which a to-be-anodized film is to be formed, in an electrolytic solution in which a cathode is soaked;

applying a voltage between the cathode and the to-be-anodized film, said to-be-anodized film functioning as an anode;

measuring a resistivity of the electrolytic solution as said voltage is applied between the cathode and the to-be-anodized film; and then adding a solution including an additive consisting of ammonia water and hydrogen ions, to the electrolytic solution to control the resistivity of the electrolytic solution so that the electrolytic solution has a resistivity falling within a range in which a density of defects in the to-be-anodized film as the to-be-anodized film is anodized, is substantially stable.

17. The anodizing method according to claim 16, wherein:

said electrolytic solution is an ammonium borate water solution; and said adding step includes a step of adding ammonia water to the electrolytic solution so that the resistivity of the electrolytic solution falls within said range, said range being from 100 to 120 Ωcm, in response to the resistivity measured in the measuring step.

18. The anodizing method according to claim 16, wherein said ions include hydrogen ions.

19. An anodizing method, comprising the steps of:

soaking a substrate on which a to-be-anodized film is formed in an electrolytic solution in which a cathode is soaked;

applying a voltage between the cathode and the to-be-anodized film, said to-be-anodized film functioning as an anode, thereby anodizing the to-be-anodized film;

measuring a resistivity of the electrolytic solution; and maintaining the measured resistivity of the electrolytic solution within a range, in which a density of defects in the to-be-anodized film by adding a solution including an additive consisting of ammonia water and hydrogen ions thereto, as the to-be-anodized film is anodized, is substantially stable, in response to the resistivity measured in the measuring step.

20. The anodizing method according to claim 19, wherein:

said electrolytic solution is an ammonium borate water solution; and said maintaining step includes a step of adding ammonia water to the electrolytic solution so that the resistivity of the electrolytic solution falls within said range, said range being from 100 Ωcm to 120 Ωcm, in response to the measured resistivity measured in the measuring step.

21. An anodizing method comprising the steps of:

soaking a substrate on which a to-be-anodized film is to be formed in an electrolytic solution in which a cathode is soaked;

the electrolytic solution including a volatile material, and wherein a resistivity of the electrolytic solution changes in accordance with an evaporation of the volatile material;

applying a voltage between the cathode and the to-be-anodized film, said to-be-anodized film functioning as an anode, thereby anodizing the to-be-anodized film;

measuring a resistivity of the electrolytic solution as said to-be-anodized film is anodized; and adding the volatile material to the electrolytic solution to maintain the resistivity of the electrolytic solution within a range in which a density of defects in the to-be-anodized film, during anodization thereof, is substantially stable, in response to the resistivity measured in the measuring step.

22. An anodizing method in which a defect density in an anodized film changes in accordance with a resistivity of an electrolytic solution used for anodizing a to-be-anodized film, comprising the steps of:

soaking a substrate on which the to-be-anodized film is formed, in an electrolytic solution in which a cathode is soaked;

applying a voltage between the cathode and the to-be-anodized film, the to-be-anodized film functioning as an anode, thereby anodizing the to-be-anodized film;

measuring a resistivity of the electrolytic solution as said to-be-anodized film is anodized; and maintaining the resistivity of the electrolytic solution within a first range during anodizing of the to-be-anodized film by adding a solution including an additive consisting of ammonia water and hydrogen ions thereto in response to the resistivity measured in the measuring step, thereby maintaining the defect density of the anodized film in a second range that corresponds to the first range.

23. The anodizing method according to claim 22, wherein the first range is from 100 Ωcm to 120 Ωcm.

24. The anodizing method according to claim 23, wherein:

said electrolytic solution is an ammonium borate water solution; and said maintaining step includes a step of adding ammonia water to the electrolytic solution so that the resistivity of the electrolytic solution falls within the first range, in response to the resistivity measured in the measuring step, thereby maintaining the defect density in the second range that corresponds to the first range.

* * * * *